US009424730B2

(12) United States Patent
Holm et al.

(10) Patent No.: US 9,424,730 B2
(45) Date of Patent: Aug. 23, 2016

(54) DEVICE FOR PROVIDING DIRECTIONAL GUIDANCE WHILE SWIMMING

(71) Applicant: Solarstone, Inc., Eagle Mountain, UT (US)

(72) Inventors: Stephen Holm, Eagle Mountain, UT (US); Raymond Rogers, Eagle Mountain, UT (US)

(73) Assignee: Solarstone, Inc., Eagle Mountain, UT (US)

( * ) Notice: Subject to any disclaimer, the term of this patent is extended or adjusted under 35 U.S.C. 154(b) by 0 days.

(21) Appl. No.: 14/451,060

(22) Filed: Aug. 4, 2014

(65) Prior Publication Data

US 2015/0042476 A1 Feb. 12, 2015

Related U.S. Application Data

(60) Provisional application No. 61/862,681, filed on Aug. 6, 2013.

(51) Int. Cl.
*G08B 23/00* (2006.01)
*G08B 21/08* (2006.01)

(52) U.S. Cl.
CPC ..... *G08B 21/088* (2013.01)

(58) Field of Classification Search
CPC ..... G02B 6/00; G02B 2027/0178
USPC ..... 340/573.1, 539.13, 686.1; 434/254; 701/468; 702/19
See application file for complete search history.

(56) References Cited

U.S. PATENT DOCUMENTS

| | | | | |
|---|---|---|---|---|
| 3,802,088 | A | 4/1974 | Barrett et al. | |
| 4,103,279 | A | 7/1978 | Dildy, Jr. et al. | |
| 6,086,379 | A * | 7/2000 | Pendergast et al. | 434/254 |
| 6,366,856 | B1 | 4/2002 | Johnson | |
| 2008/0066331 | A1 | 3/2008 | Brzezinski et al. | |
| 2010/0030482 | A1* | 2/2010 | Li | 702/19 |
| 2011/0054834 | A1 | 3/2011 | Partridge et al. | |
| 2011/0128824 | A1 | 6/2011 | Downey et al. | |
| 2012/0009553 | A1* | 1/2012 | Ben-Tal | 434/254 |
| 2013/0187786 | A1* | 7/2013 | Dadlani Mahtani et al. | 340/691.8 |
| 2015/0025794 | A1 | 1/2015 | Long et al. | |

* cited by examiner

*Primary Examiner* — Julie Lieu
(74) *Attorney, Agent, or Firm* — David R. Conklin; Kirton McConkie

(57) ABSTRACT

The present invention is generally directed to a device that provides haptic, auditory and/or visual indications representing a swimmer's deviation from an intended path. Visual indications can be displayed on one or more lenses of the swimmer's goggles. In this way, the swimmer can receive continuous guidance to swim in a desired direction without lifting his head to sight. The device can be configured as a base unit that can be worn on the head and an eyepiece that is attached to a lens of the swimmer's goggles. The eyepiece can include one or more LEDs for displaying the visual indications based on information received from the base unit.

19 Claims, 12 Drawing Sheets

DEVICE FOR PROVIDING DIRECTIONAL GUIDANCE WHILE SWIMMING

RELATED APPLICATIONS

This application claims priority to U.S. Provisional Patent application Ser. No. 61/862,681, filed on Aug. 6, 2013 and titled GPS DEVICE FOR PROVIDING DIRECTIONAL GUIDANCE WHILE SWIMMING, which is incorporated herein by reference, in its entirety.

BACKGROUND

Many devices have been developed for monitoring a person's performance while exercising. For example, GPS devices have been used while running, biking, and swimming to track speed and distance among other parameters. These parameters are calculated using a series of GPS coordinates determined by the device along with a time when each of the GPS coordinates is determined.

GPS devices are more commonly used while running and biking because the information displayed by such devices can be easily viewed during these activities (e.g. because the GPS device can be worn on the arm or mounted to the bike which can remain stationary without impacting the performance of the activity). While swimming, however, it is difficult to view the information provided by a GPS device. For example, while swimming, a person cannot stop the motion of his arm without significantly affecting his performance. For this reason, GPS devices designed for swimmers are oftentimes configured to be worn on the head. Also, some recent GPS devices have been designed to output some information for display in the lens of the swimmer's goggles.

Open-water swimming also presents a problem that is not present when running or biking. When swimming in the open water, it is difficult to swim in a straight line towards an intended destination. For example, some swimmers naturally swim in a curved line due to imbalances in their stroke. Currents in the open water can also cause a swimmer to swim in an undesired direction. To address the difficulty of swimming in a straight line, many swimmers will use a sighting technique. When sighting, a swimmer will periodically lift his head out of the water in an attempt to see a landmark that he is using as a guide. In this way, the swimmer can determine if he has deviated from his intended path and can adjust his direction accordingly.

Sighting poses various difficulties. For example, because the swimmer must lift his head, sighting tends to slow the swimmer's speed and increases the exertion required to reach a destination. Also, when no obvious landmark exists or high waves make it difficult to see a landmark, it can require more time to locate a landmark during each sighting. This additional time can cause the swimmer to lose some or even all his momentum (e.g. when his feet sink into the water) further slowing his speed and increasing the exertion required. Further, if the swimmer is consistently deviating from a straight line path, the swimmer may swim a significantly longer distance than intended. Swimming this extra distance can be very undesirable in races such as triathlons both because of the additional time required to swim the extra distance as well as the additional energy exerted to cover the extra distance.

BRIEF SUMMARY

The present invention is generally directed to a GPS device that provides visual indications representing a swimmer's deviation from an intended direction. The visual indications can be displayed on one or more lenses of the swimmer's goggles. In this way, the swimmer can receive continuous guidance to swim in a desired direction without lifting his head to sight.

The GPS device can be configured as a base unit that can be worn on the head (e.g. attached to the strap of the swimmer's goggles or under a swim cap) and an eyepiece that is attached to a lens of the swimmer's goggles. The eyepiece can include one or more user interface components for displaying or otherwise providing the user with directions or other information based on information received and derived from the base unit. In some instances, the eyepiece includes one or more LEDs (Light Emitting Diodes) for displaying visual information to the user. In other instances, the eyepiece or base comprises one or more non-LED user interface components, such as a haptic feedback component or auditory feedback component, as discussed below.

In some embodiments, the GPS device can include functionality for determining a swimmer's intended direction using a history of GPS coordinates calculated by the device. In other embodiments, an intended direction can be preprogrammed into the device such as by specifying a direction or a known course. In any case, the GPS device can identify when the swimmer's current direction has deviated from the intended direction and can provide visual indications to notify the swimmer of the deviation.

This summary is provided to introduce a selection of concepts in a simplified form that are further described below in the Detailed Description. This Summary is not intended to identify key features or essential features of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
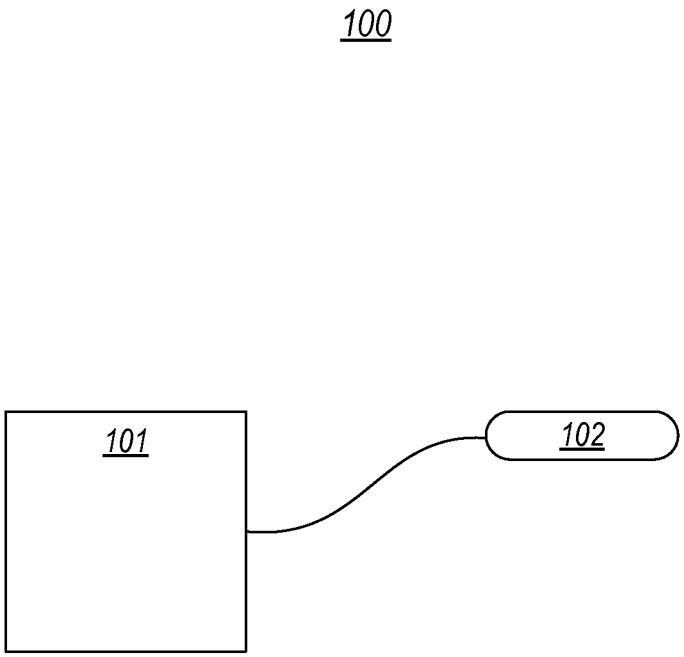
FIG. 1 illustrates an example of a GPS device having a base unit and an eyepiece.

The present invention is generally directed to a GPS device that provides visual indications representing a swimmer's deviation from an intended path. The visual indications can be displayed on one or more lenses of the swimmer's goggles. In this way, the swimmer can receive continuous guidance to swim in a desired direction without lifting his head to sight. The swimmer also gains confidence in their direction during times when sighting is difficult due to environmental conditions.

The GPS device can be configured as a base unit that can be worn on the head (e.g. attached to the strap of the swimmer's goggles or under a swim cap) and an eyepiece that is attached to a lens of the swimmer's goggles. The eyepiece can include one or more LEDs for displaying the visual indications based on information received from the base unit.

In some embodiments, the GPS device can include functionality for determining a swimmer's intended direction using a history of directional information, such as GPS coordinates, orientations, gravitational fields, or headings calculated by the device. In other embodiments, an intended direction can be preprogrammed into the device such as by specifying a direction or a known course. In any case, the GPS device can identify when the swimmer's current direction has deviated from the intended direction and can provide visual indications to notify the swimmer of the deviation.

Example Computer Environment

Embodiments of the present invention may comprise or utilize special purpose or general-purpose computers including computer hardware, such as, for example, one or more processors and system memory, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system.

Computer-readable media is categorized into two disjoint categories: computer storage media and transmission media. Computer storage media (devices) include RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other similarly storage medium which can be used to store desired program code means in the form of computer-executable instructions or data structures and which can be accessed by a general purpose or special purpose computer. Transmission media include signals and carrier waves.

Computer-executable instructions comprise, for example, instructions and data which, when executed by a processor, cause a general purpose computer, special purpose computer, or special purpose processing device to perform a certain function or group of functions. The computer executable instructions may be, for example, binaries, intermediate format instructions such as assembly language or P-Code, or even source code.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like.

The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices. An example of a distributed system environment is a cloud of networked servers or server resources. Accordingly, the present invention can be hosted in a cloud environment.

GPS Device for Providing Directional Guidance while Swimming

FIG. 1 illustrates a non-limiting example of a GPS device 100 for providing directional guidance while swimming. GPS device 100 includes a base unit 101 and an eyepiece 102. In some instances, base unit 101 and eyepiece 102 comprise a monolithic unit or structure that is wearable on, near to, or embedded within a swimmer's goggles. Base unit 101 can include any compatible direction sensing component. For example, in some instances base unit 101 comprises circuitry for receiving GPS signals and calculating directional information, such as GPS coordinates, from these signals. Base unit 101 can also be configured to identify an intended direction of a swimmer wearing GPS device 100, to calculate whether a current direction of the swimmer deviates from the intended direction, and to output signals to eyepiece 102 when it is determined that the swimmer has deviated. These functions performed by base unit 101 are described more fully below with respect to FIGS. 2-8.

In some instances, eyepiece 102 is configured to be attached to a lens of the swimmer's goggles and includes a plurality of LEDs which are used to convey directional information to the swimmer. Eyepiece 102 can be shaped in such a way that it can be attached to virtually any type of swim goggle. In some embodiments, components other than LEDs can be used to convey information. Accordingly, the present invention is not limited to using any particular type of display component for providing visual indications to a swimmer. In some instances, a high resolution optical display is used, wherein the display is capable of showing information such as alpha-numerical text, maps, images, etc. Non-limiting examples of various possible configurations of an eyepiece 102 are described below with reference to FIG. 9-11.

Eyepiece 102 can be connected to base unit 101 in any suitable way. For example, eyepiece 102 can be wired to base unit 101 as shown in FIG. 1. The wire can be used to transmit signals to eyepiece 102 as well as to supply power for operating the components on eyepiece 102 (e.g. the LEDs and processing circuitry). Alternatively, eyepiece 102 can be configured to communicate wirelessly with base unit 101 (e.g. via Bluetooth). Accordingly, the particular manner in which eyepiece 102 and base unit 101 communicate is not essential to the invention.

Base unit 101 can be configured to operate in various different modes. These modes differ in how an intended direction of a swimmer is calculated. The modes include: (1) a pre-programmed course mode; (2) a pre-programmed direction mode; (3) a freestyle mode; and (4) a partner mode. In any of the modes, base unit 101 can calculate a current direction the swimmer is traveling using a history of GPS coordinates (e.g. the GPS coordinates for the past x feet). Based on the mode, a longer history of GPS coordinates may be required as will be described below.

Pre-Programmed Course Mode

In the pre-programmed course mode, a known course is pre-programmed into base unit 101 prior to swimming. For example, base unit 101 can be configured to interface with a personal computer or other computing device which stores information defining a known course (e.g. a GPX file). The known course can be transferred and stored on base unit 101. Then, when the swimmer is ready to swim the known course, he can provide input to base unit 101 selecting the known course and begin swimming.

Figure 2:
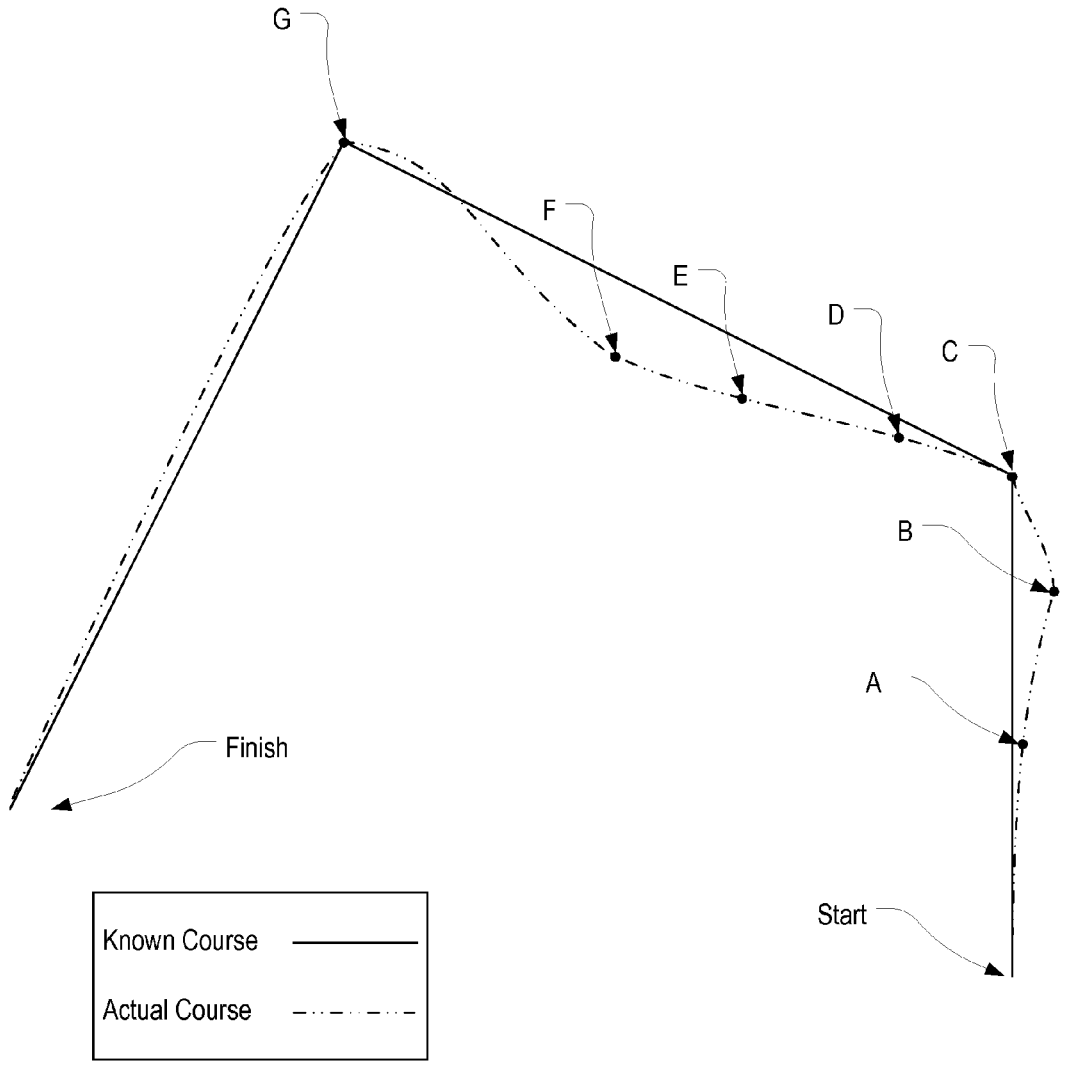
FIG. 2 illustrates how the base unit of the GPS device can identify a deviation from an intended direction when in a pre-programmed course mode.

FIG. 2 represents how base unit 101 can identify a deviation from an intended direction when in the pre-programmed course mode. FIG. 2 shows a known course (in solid lines) along with the actual course (in dashed lines) that the swimmer traversed. The actual course indicates that the swimmer deviated from the known course at multiple times during the swim. Because base unit 101 knows the direction information or GPS coordinates of the known course and knows the actual directional information or coordinates of the swimmer's current location, base unit 101 can output signals to cause eyepiece 102 to display visual indications representing the correctness of the swimmer's current path. In such cases, only the current GPS coordinates may be required. References below to base unit 101 displaying visual indications should be understood as meaning that base unit 101 is outputting the appropriate signals to cause the visual indications to be displayed on eyepiece 102.

At point A, base unit 101 can compare the current GPS coordinates to those of the known course to identify that the swimmer has deviated 20 feet from the known course. In response, base unit 101 can inform the swimmer of the deviation. In some embodiments, this can be accomplished by displaying an indication of the direction to swim to return to the path. For example, because base unit 101 knows that the swimmer intends to reach point C, it can display an indication to swim in the direction defined by a line between point A and point C (or another point along the initial leg of the known course prior to point C). Alternatively, rather than displaying the direction to swim, base unit 101 can display an indication that the swimmer is swimming in the wrong direction. For example, base unit 101 can display an indication that the swimmer's current direction is at an angle to the right of the intended direction. In such cases, the indication can be displayed until it is determined that the swimmer's current direction is the appropriate direction (e.g. using a history of most recent GPS coordinates to identify a current direction).

Accordingly, base unit 101 can display two types of visual indications in the pre-programmed course mode: (1) indications defining the direction to swim (because the destination is known); and (2) indications defining the direction of a deviation (because the intended direction is known). In the pre-programmed course mode, indications defining the direction to swim may be preferred because they accurately define a straight line path to the destination.

Referring again to FIG. 2, in spite of any indication displayed at point A, the swimmer continued to swim in the wrong direction until point B. Because the swimmer's path continued in the wrong direction between points A and B, the appropriate visual indications would have been displayed until point B. However, at point B, the swimmer has corrected his course and has begun swimming in the appropriate direction towards point C. Accordingly, between points B and C, base unit 101 can display an indication that the current direction is the appropriate direction.

After passing point C, the swimmer again begins to deviate from the known course, this time drifting to the left. At point D, base unit 101 can determine that the deviation exceeds some threshold and display an appropriate indication. Such indications can continue to be displayed until point F when the swimmer corrects his course and begins swimming towards point G. Finally, between points G and the finish, the swimmer generally follows the known course. Accordingly, during this time, base unit 101 can display an indication that the swimmer is swimming in the right direction or may otherwise display no indications (e.g. when only indications of deviations are displayed).

FIG. 2 illustrates that the swimmer has deviated from the course substantially during the first and second legs of the course. These deviations are shown to better explain how base unit 101 provides directional guidance. However, a primary reason for swimming with GPS device 100 is to prevent or at least minimize such deviations. As stated above, base unit 101 can display indications that the swimmer has begun to deviate beginning at point A and D. If the swimmer had followed these indications, he would have quickly returned on course rather than continuing to deviate to points B and F respectively. Accordingly, the actual course that the swimmer may follow while swimming the known course in FIG. 2 using GPS device 100 would desirably include smaller deviations.

Pre-Programmed Direction Mode

In the pre-programmed direction mode, the swimmer provides input defining one or more directions he intends to swim. For example, the swimmer may specify that he wants to swim 1 mile to the north or 1 mile at a specified angle from north. Alternatively, the swimmer may specify a direction without specifying a distance. In either case, the determination of a deviation from the intended direction is made in a similar manner as in the pre-programmed course mode. In other words, because the destination is known (e.g. 1 mile north of the starting location) or a straight line to the destination is known (e.g. a line pointing north from the starting location), base unit 101 can display indications defining a direction to swim or a deviation from the intended direction.

Figure 3A:
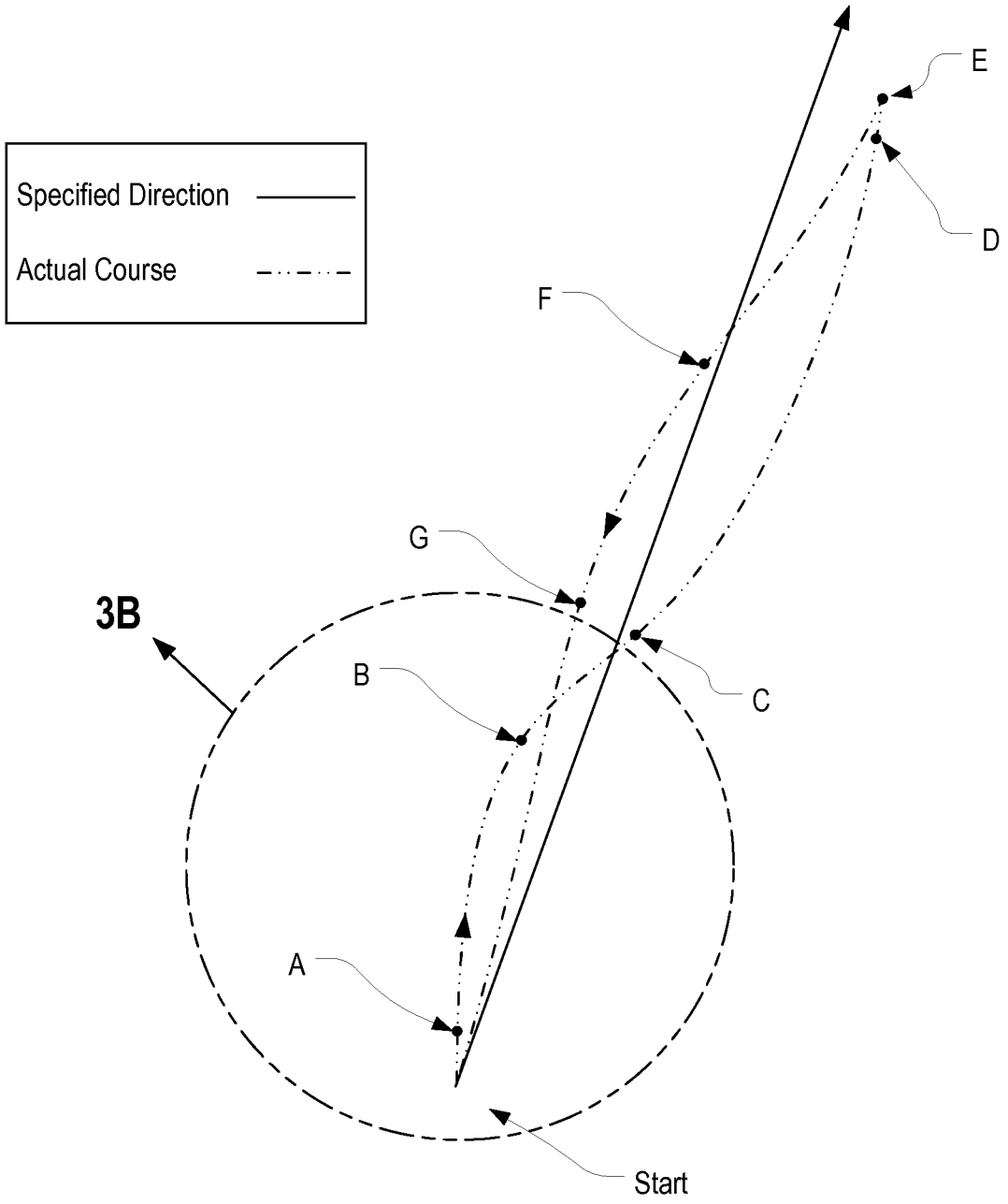
FIGS. 3A and 3B illustrate how the base unit of the GPS device can identify a deviation from an intended direction when in a pre-programmed direction mode.

FIG. 3A represents how base unit 101 can identify a deviation in the pre-programmed direction mode when a distance is not specified. When a distance is specified, base unit 101 can identify a deviation in the same manner described above for the pre-programmed course mode. FIG. 3A represents the case where the swimmer has input an intended direction of 20 degrees but no desired distance to swim.

Because the starting location and the intended direction are known in the pre-programmed direction mode, base unit 101 knows the line along which the swimmer should swim if he swims in the correct direction. With this information, base unit 101 can provide visual indications to notify the swimmer when he has deviated from this line.

As shown in FIG. 3A, the swimmer initially begins to swim in the wrong direction. At point A, base unit 101 can determine that the distance from the intended line exceeds some threshold and can output an appropriate visual indication. For example, as with the pre-programmed course mode, the visual indication can represent the direction to swim to get back on course or can represent the direction of the deviation.

Figure 3B:
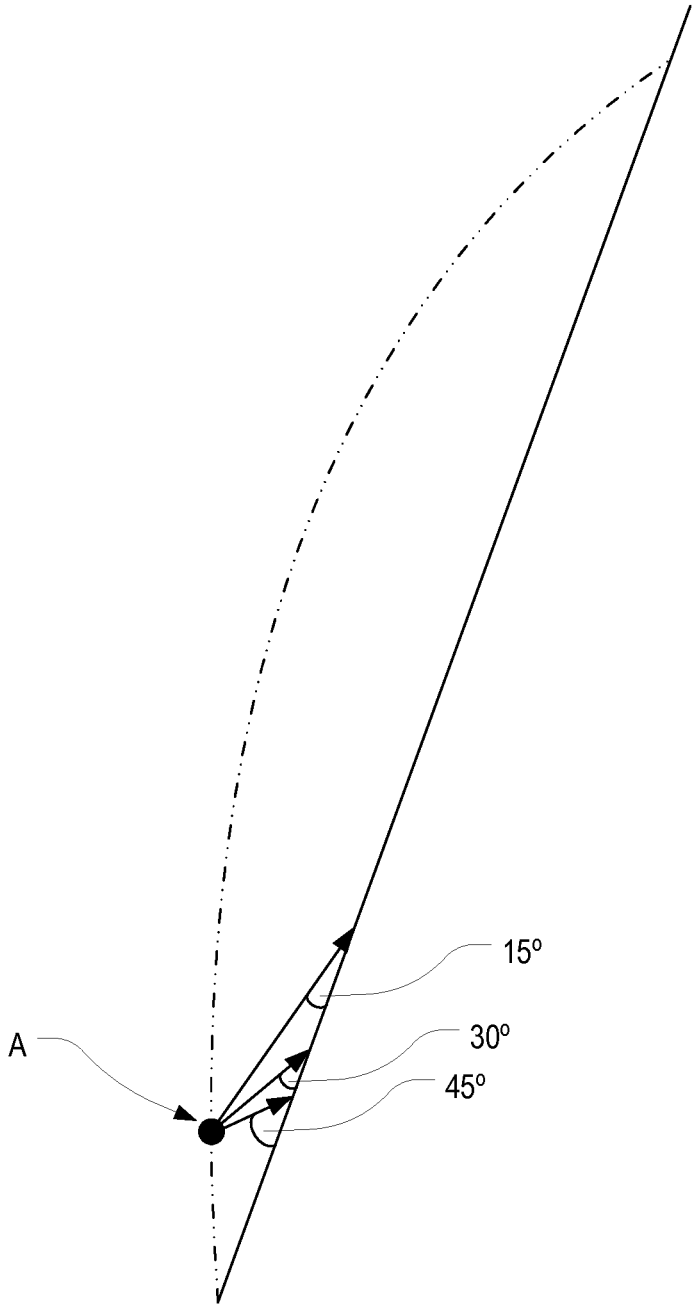

Because it is not known what the ultimate destination is (which in this example is the point at which the swimmer will turn around), base unit 101 cannot determine a straight line direction to the destination. Therefore, base unit 101 can recommend swimming in a direction that will intersect with the intended direction without requiring the swimmer to sharply change his direction. FIG. 3B illustrates how this can be done.

In FIG. 3B, various arrows are shown representing recommended directions that base unit 101 can determine when the swimmer is at point A. The particular angle (e.g. 15°, 30°, or 45°) used to determine the recommended direction can be based on one or more factors. For example, when a smaller angle is used, a longer distance will be swum before the swimmer returns to the intended line. Therefore, the angle can be user configurable or can be dynamically determined.

A dynamic determination of the angle can be based on where in a swim the deviation occurs. For example, base unit 101 can store many swims the swimmer has performed. Based on the swimmer's history, it can be determined that the swimmer usually swims a certain distance. In such cases, if the deviation occurs early in the swim, a smaller angle can be used in the determination because it is likely that the swimmer will not turn around for a substantial distance. The use of the smaller angle can result in the swimmer swimming a shorter overall distance. Similarly, the distance that the swimmer has deviated can be used in determining the recommended angle to return to course. For example, if the distance of the deviation is large, a larger angle may be used so that the distance traveled to return on course is not too large.

Alternatively, in some embodiments, base unit 101 may not attempt to direct the swimmer back to the intended line, but may simply provide indications for directing the swimmer back in the direction the swimmer initially specified. For example, at point A, base unit 101 may display indications to cause the swimmer to begin swimming in the 20 degree direction from his current location. If the swimmer follows the indications, his actual path should be substantially parallel to the intended line.

Returning again to FIG. 3A, between points A and B, base unit 101 can continue to display indications instructing the swimmer to turn towards the right to return to the intended line. At point B, because the swimmer's current direction will return him on course, base unit 101 may cease displaying indications to turn right.

At point C, base unit 101 can provide indications similar to those provided at point A. In other words, because at point C the swimmer is heading in the wrong direction, base unit 101 can provide a visual indication to return the swimmer on course. These indications can be provided until point D when base unit 101 determines that the swimmer's direction will return him on course within a specified distance.

At point E, the swimmer turns around. Although the swimmer's current location is a distance from the intended line, base unit 101 may not provide visual indications because the swimmer's current direction will return him to the intended line. At points F and G, base unit 101 can respond in a similar manner as with points C and D.

Accordingly, in the pre-programmed direction mode when no distance is specified, base unit 101 can identify when the swimmer's direction deviates from the intended direction and can provide indications to guide the swimmer back to the intended line or alternatively in the desired direction. In either case, the visual indications can be in the form of a direction to swim or a direction of the deviation.

As with FIG. 2, the actual course shown in FIG. 3A includes substantial deviations from the specified direction to better illustrate how base unit 101 can provide directional guidance. In a typical scenario where GPS device 100 is used and the indications provided by base unit 101 were followed, the actual course followed by the swimmer would not deviate substantially from the specified direction.

Freestyle Mode

In freestyle mode, base unit 101 has no prior knowledge of the direction the swimmer intends to swim. Accordingly, in this mode, base unit 101 uses the history of GPS coordinates to estimate an intended direction. Freestyle mode can be used when the swimmer desires to swim in a straight line but does not know what direction the straight line will follow. For example, freestyle mode can be used during a race or a training swim when the exact coordinates of the course are not known beforehand. In many open water races, the exact course is not known. Therefore, freestyle mode can be used to assist the swimmer in swimming straight without needing to repeatedly sight.

In freestyle mode, because it is not known beforehand what the intended direction is, base unit 101 can use the path traveled by the swimmer to determine the intended direction. In other words, base unit 101 uses the assumption that the swimmer will begin swimming in the correct direction and can use this initial direction for providing directional guidance during the subsequent portions of the leg of the course. Base unit 101 may further, or alternatively, use directional orientation information gathered from magnometers (i.e. a compass chip) to determine instantaneous intended direction, thereby obviating the need to rely on the path traveled by the swimmer.

Figure 4:
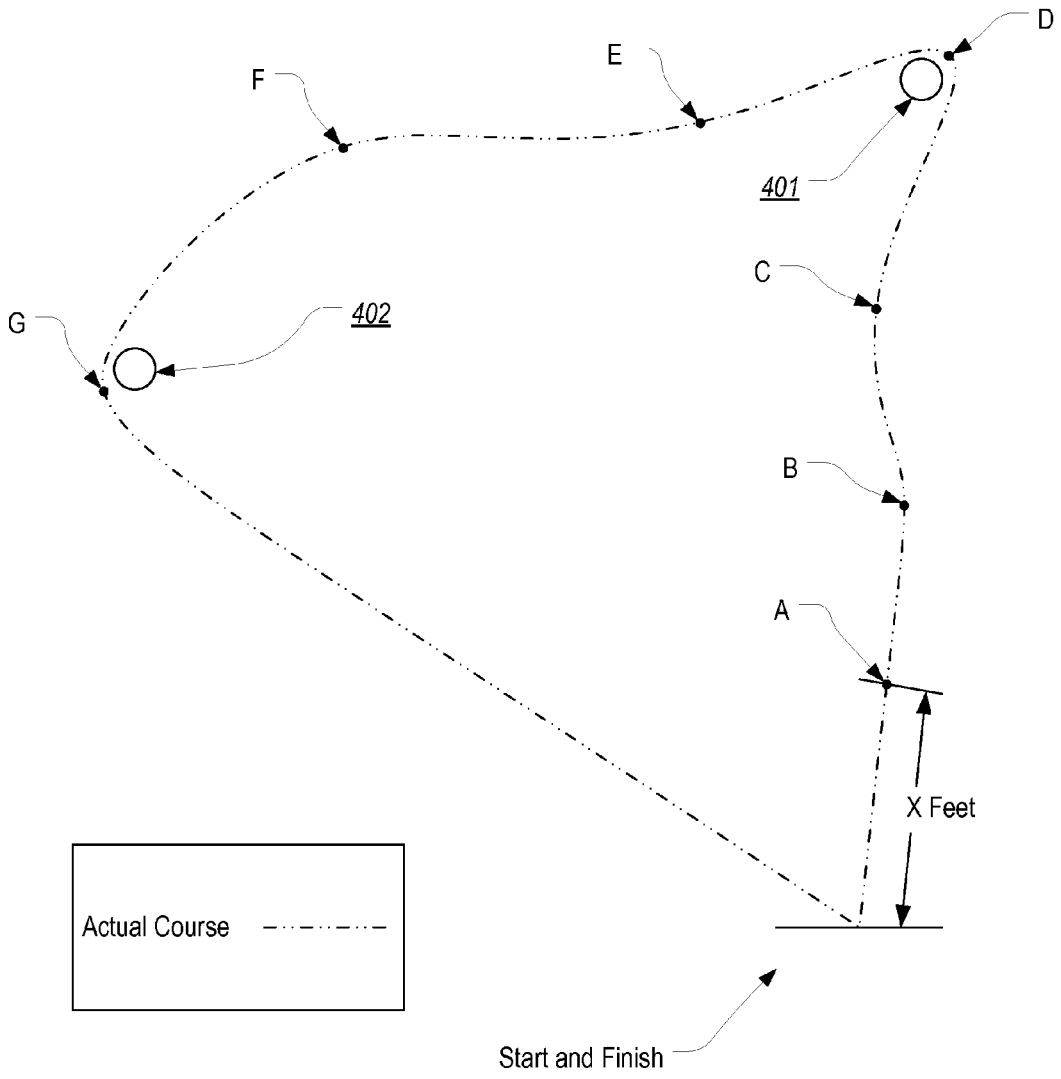
FIG. 4 illustrates how the base unit of the GPS device can identify a deviation from an intended direction when in a freestyle mode.

FIG. 4 shows a course that is marked with two buoys 401, 402 with the start and the finish of the course being the same location. This course can represent a typical swimming course of a triathlon or other race. As shown, the swimmer initially begins swimming in a correct direction towards buoy 401 (from the start line to point B). As base unit 101 generates GPS coordinates over an initial distance (shown as X feet between the start line and point A), base unit 101 can calculate an intended direction. In the depicted example, base unit 101 can determine that the intended direction is the direction of the line from the start line to point A.

In some embodiments, base unit 101 can use the initial 50 feet of a swim to determine the intended direction (i.e. X=50'). However, other distances can equally be used. For example, distances between 25 to 100 feet can be used. This distance may, in some embodiments, be a user configurable parameter.

Although FIG. 4 illustrates that the swimmer has traversed a straight line between the start line and point A, an intended direction can also be calculated when the swimmer traverses a non-straight line over this distance. In other words, base unit 101 can use the starting and ending points of the initial distance in calculating the intended direction (e.g. the GPS coordinates of base unit 101 at the start line and the GPS coordinates of base unit 101 after having traversed X feet (i.e. at point A)). Therefore, the calculation of the intended direction assumes that the swimmer will initially swim in the right direction and will therefore not be substantially off course after swimming X feet.

Once the intended direction is known, base unit 101 can monitor the swimmers current direction and can provide indications when the swimmer's current direction deviates from the intended direction. The identification of deviations from the intended direction occurs in a similar manner as described above in the pre-programmed course and direction modes. For example, GPS unit can determine a current direction from previous GPS coordinates (over a distance less than X), and can compare this current direction to the intended direction.

In contrast to the pre-programmed course and direction modes, in one embodiment of freestyle mode, base unit 101 continuously updates the intended direction based on the current location of the swimmer. Because base unit 101 does not know whether the calculated intended direction is in fact the correct direction, base unit 101 dynamically updates the intended direction. For example, if point A were off course, the intended direction calculated by base unit 101 would be an incorrect direction for reaching buoy 401. In such a case, the swimmer may identify that he is off course (e.g. by sighting) and may correct his direction. Then, the GPS coordinates generated as the swimmer swims in the correct direction will be used in the calculation of the intended direction. In this case, after the swimmer turns in the correct direction, base unit 101 would initially display indications that the swimmer is heading in the wrong direction because the calculation would be based on the incorrect intended direction caused by the swimmer initially heading in the wrong direction. However, as the swimmer traverses a greater distance in the new direction, the calculated intended direction will become more accurate, and consequently, base unit 101 would soon cease to notify the swimmer that he is heading in the wrong direction. A more detailed example of how the intended direction is calculated in Freestyle mode is provided below with reference to FIGS. 6 and 7.

Returning to FIG. 4, between points A and B, base unit 101 will determine that the swimmer is heading in the correct direction (i.e. he continues to follow the same direction calculated as the intended direction at point A). Then, shortly after point B (e.g. after 5 feet, 10 feet, or some other distance), base unit will determine that the swimmer's current direction deviates from the intended direction. For example, base unit 101 can determine that the swimmer is now swimming in a slightly northwest direction when the intended direction is slightly northeast. Accordingly, base unit 101 can display an indication that the swimmer has deviated to the left of the intended course.

An indication of the deviation can be displayed until point C (or slightly after point C) when it is determined that the swimmer has returned to swim in the intended direction. The intended direction at point C may be different from the originally calculated intended direction due to the distance the swimmer traversed in a different direction between points B and C which will be further described below with reference to FIG. 7.

At point D, the swimmer has reached buoy 401 and therefore turns to swim towards buoy 402. Base unit 101 can be configured to detect when a turn exceeds some threshold level (e.g. greater than 45°), and in response, can commence calculating a new intended direction. In other words, at point D, base unit 101 can identify that the swimmer has turned to commence a new leg of the course. Base unit 101 can then begin calculating the intended direction in a similar manner as initially calculated between the start line and point A.

The greater the angle of the turn the faster base unit 101 can confirm a new direction is required. By using this approach even a small change in angle over a larger period of time can indicate a new intended direction. This helps when the swimmer needs a shallow turn or when the original intended direction was significantly off. In some instances, a swimmer may desire to discard a current directional target heading and set a new directional target heading. Thus, for some embodiments base unit 101 may further comprise a feature whereby the swimmer may manually override a current directional target heading in favor of a new directional target heading. For example, in one embodiment base unit 101 comprises a button that is easily accessible to the swimmer and may be pushed by the swimmer to set a new directional target heading. Thus, at any point in time the swimmer may manually indicate a new directional target heading, as desired.

Then, at point E, after a new intended direction has been calculated (i.e. the direction of a line between buoy 401 and buoy 402), base unit 101 can determine that the swimmer has begun to deviate from the intended direction and can provide indications accordingly. By point F, the swimmer has corrected his direction to be close to the intended direction. As a result, base unit 101 may cease providing indications of the deviations. Between points F and G, because the current direction deviates to the left of the intended direction, base unit 101 may actually provide indications that the swimmer is deviating to the left (because base unit 101 does not know that the swimmer will be turning at buoy 402). However, because the swimmer may be able to easily see buoy 402 after point F, the indications of the leftward deviation may not cause the swimmer to turn back to the right.

Finally, at point G, the swimmer again makes a substantial turn that may be identified as an intentional turn causing base unit 101 to commence calculating a new intended direction. Between point G and the finish line the swimmer follows a straight path (e.g. because he heeds the indications received from base unit 101 that he is swimming in the correct direction or otherwise responds quickly to indications that he has deviated by correcting his direction).

To summarize, in freestyle mode, base unit 101 performs two general calculations: (1) the calculation of the intended direction, either based on a previous path and/or distance traversed, or by directional orientation at the moment of a turn or a subsequent detectable motion, such as with the use of one or more magnometers, compass chips, accelerometers, or any other direction sensing component that is capable of instantaneously determining direction; and (2) the calculation of the current direction including whether the current direction deviates from the intended direction. With both calculations, base unit 101 employs the GPS coordinates of a previously traversed path. The intended direction can be continuously updated based on the starting point for the calculation and the current location of the swimmer.

As with FIGS. 2 and 3A, the actual course traversed by the swimmer in FIG. 4 is shown with substantial deviations to better illustrate when base unit 101 provides indications of deviations. However, in a typical scenario, the swimmer will quickly correct his direction when receiving an indication that he has deviated from the intended course. Therefore, the actual course traversed when using GPS device 100 in freestyle mode would desirably be much straighter.

Partner Mode

In partner mode, two swimmers each wear a GPS device 100 with one device acting as a leader and the other acting as a follower. In this mode, base unit 101 of the follower device can provide directional indications to assist the swimmer in following his partner. This assistance can include providing directional guidance to keep the follower swimming in the same general direction as the leader as well as distance guidance to keep the follower within a specified distance from the leader.

Figure 5:
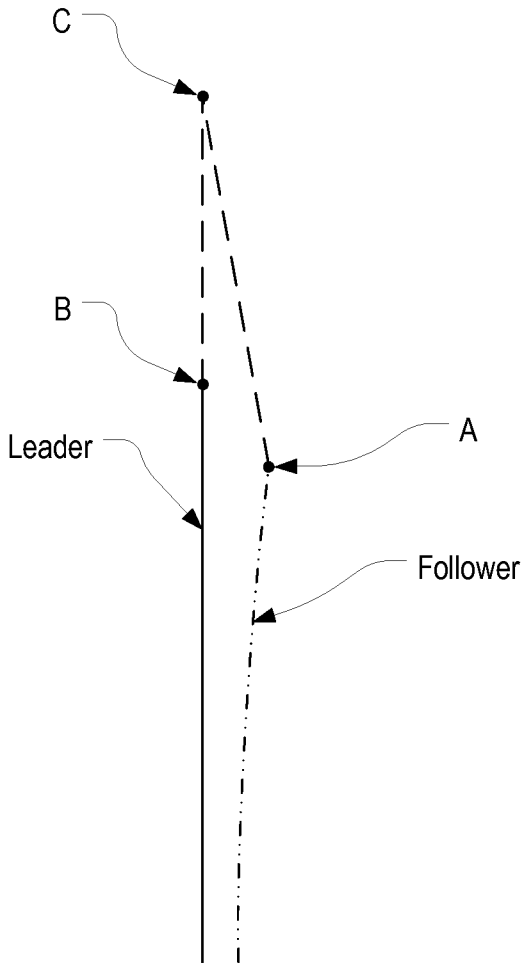
FIG. 5 illustrates how the base unit of the GPS device can identify a deviation from an intended direction when in a partner mode.

FIG. 5 illustrates an example of how base unit 101 can provide directional guidance in partner mode. As shown, the leader is swimming in a straight line while the follower has begun to deviate to the right. The base unit 101 worn by the leader can be configured to transmit directional information (e.g. headings, GPS coordinates, orientations, and/or gravitational fields) to the base unit 101 worn by the follower. The base unit 101 worn by the follower can compare the directional informational received from the leader's base unit 101 to its own directional information.

In the depicted example, the follower's base unit 101 can identify that the follower (who is represented as being at point A) is swimming in a direction that is to the right of the leader's direction (who is represented as being at point B). In response, the follower's base unit 101 can display indications to the follower recommending turning to the left. In this way, the follower and/or the leader do not need to sight to determine whether they are following the same path.

In some embodiments, one or both of the base units 101 can calculate a distance between the two base units 101 and provide an indication when the distance exceeds some threshold. For example, even if the follower is following in the same direction as the leader, it may be desirable to ensure that the leader does not get too far ahead of the follower. Accordingly, an indication can be displayed to either the leader or the follower or to both the leader and follower when the distance between the two exceeds some threshold. Such distance indications can be displayed separately from or in conjunction with directional indications. For example, the follower can be notified that he has deviated from the direction being swum by the leader and that the deviation has spaced the two swimmers in excess of a specified distance apart.

In some embodiments when partner mode is used, a directional indication can be provided that accounts for the current direction and/or speed of either or both the leader and follower. For example, referring to FIG. 5, the direction recommended to the follower to return back to the leader can account for the speed and direction of the leader. In this case, the direction recommended to the follower would be towards point C to account for the fact that the leader will be near point C by the time the follower intersects the leader's path.

To summarize, in partner mode, the follower's base unit can provide continuous guidance that will assist the follower in staying on course behind the leader. This guidance can include a direction to swim (e.g. to return to the leader when the follower has deviated) and a warning that a specified distance exists between the leader and follower.

Calculating Intended Direction and Current Direction

Figure 6:
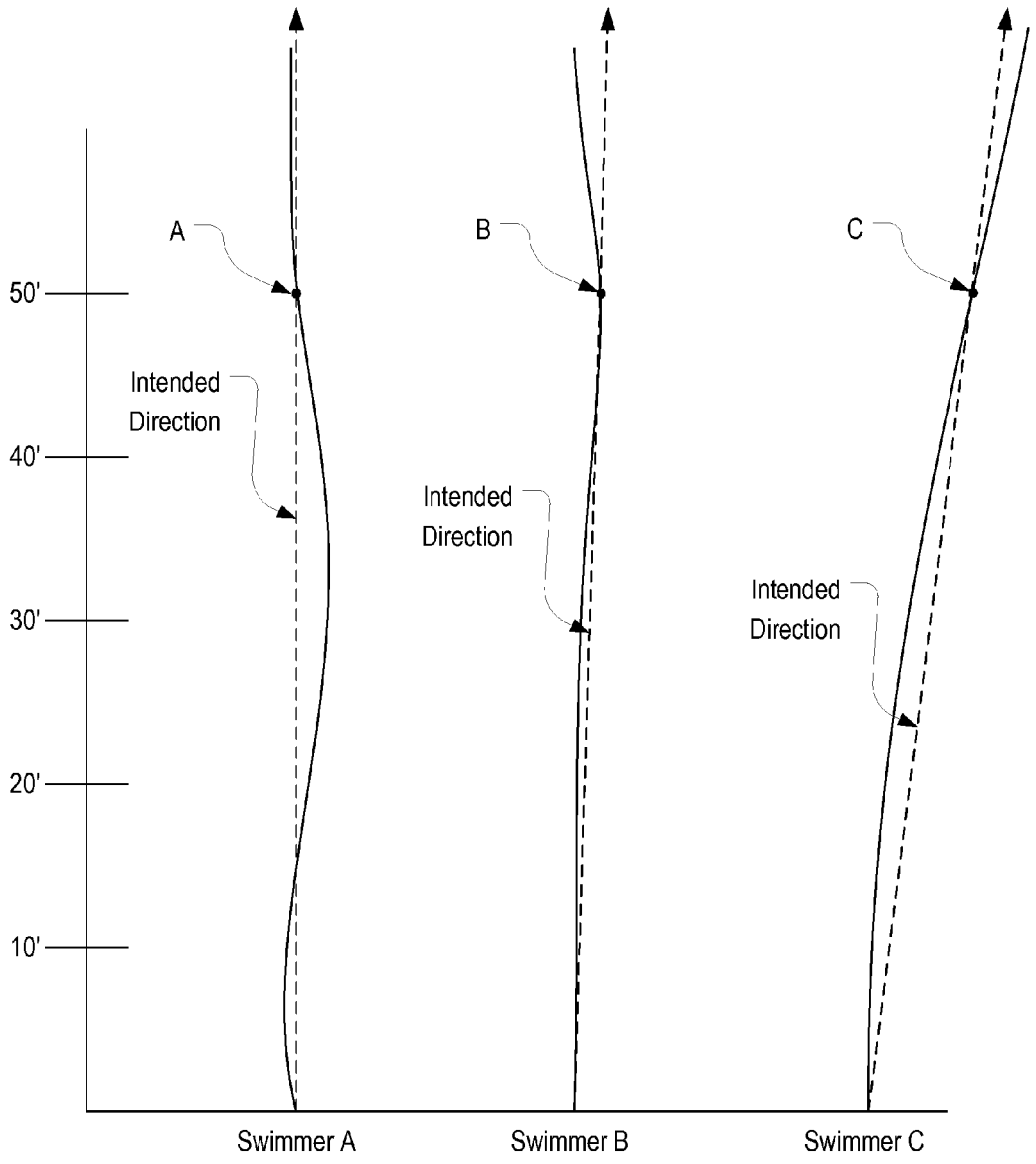
FIG. 6 illustrates an example of how the intended direction can be calculated when 50 feet is used as the threshold distance.

FIG. 6 illustrates an example of how the intended direction can be calculated when 50 feet is used as the threshold distance. In FIG. 6, the initial direction swum by each of three swimmers (Swimmers A, B, and C) is shown as a solid line. Points A, B, and C represent where swimmers A, B, and C are respectively after swimming 50 feet. The dashed line represents the intended direction that is calculated for each swimmer after 50 feet. Similar lines could be drawn if the threshold distance were defined as 10', 25', 75', 100', or another distance.

As shown, even though swimmer A initially started swimming to the left of vertical, then turned to the right before returning again to the left, the intended direction is calculated as the direction of the line between the starting point and point A (where swimmer A is located after 50 feet). From point A, base unit 101 can begin comparing a current direction to the intended direction to determine whether swimmer A should be notified to swim in a different direction. In FIG. 6, because swimmer A continues from point A in the same direction as the intended direction, base unit 101 can display an indication that swimmer A is swimming in the correct direction (or display no indication at all).

Swimmer B, on the other hand, initially swam in a vertical direction before beginning to slightly turn to the right. After swimming 50 feet, swimmer B is positioned at point B. Therefore, the intended direction calculated for swimmer B is the direction of the line from the starting point to point B. Thereafter, swimmer B turns to the left of the intended direction and can therefore be notified accordingly.

Swimmer C begins swimming to the right and continues to do so for 50 feet where he reaches point C. Therefore, swimmer C's intended direction is the direction of the line from the starting point to point C. As swimmer C begins to turn back to the left of the intended direction after point C, base unit 101 can notify swimmer C accordingly.

If it is assumed that each of swimmers A, B, and C is swimming the same course where the correct direction is directly vertical, it can be seen that only the intended direction calculated for swimmer A is completely accurate. The intended direction calculated for swimmer B is slightly to the right of vertical but may be accurate enough to not significantly impact swimmer B's performance. In contrast, the intended direction calculated for swimmer C is substantially off course and therefore will negatively impact swimmer C if he continues in this direction.

Figure 7:
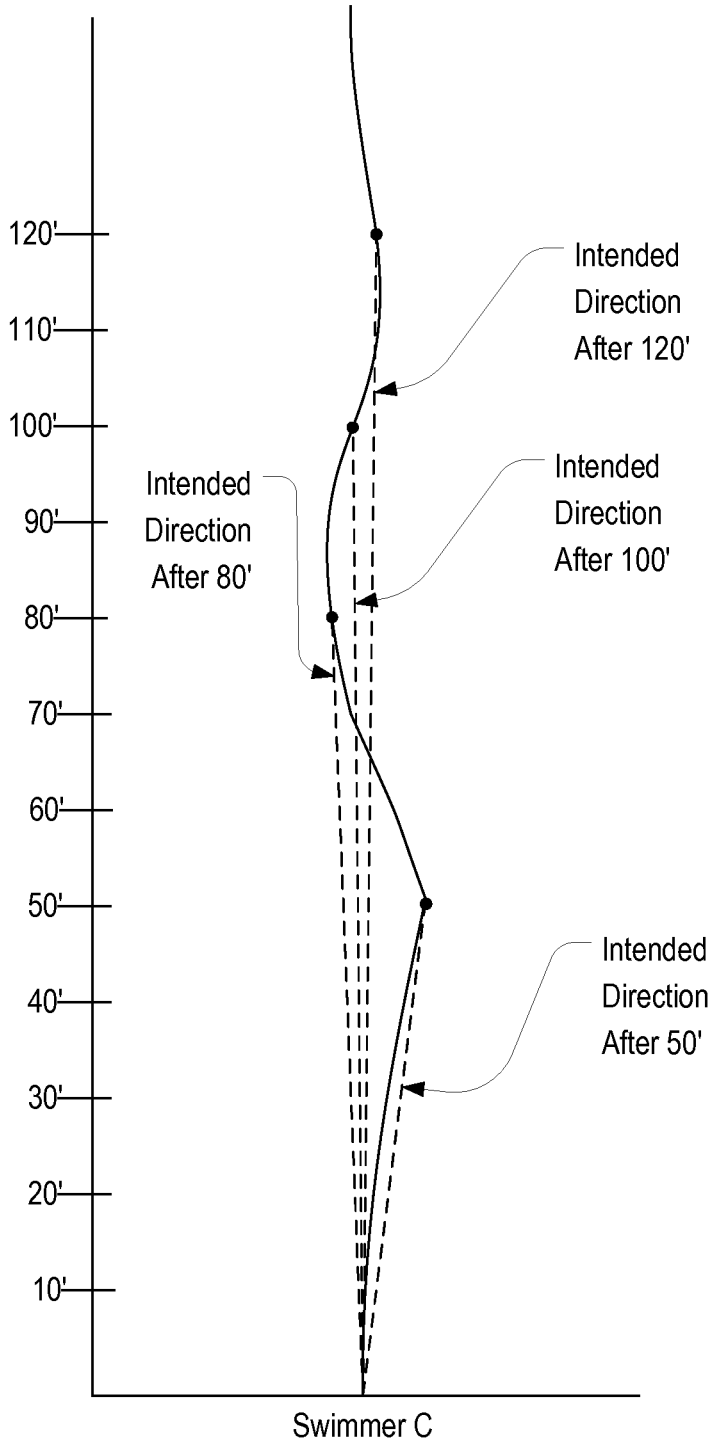
FIG. 7 illustrates how the intended direction for a swimmer can be updated after he corrects his direction.

Because the intended direction calculated in this manner may be incorrect if the swimmer does not initially swim in the correct direction, base unit 101 can continually update the intended direction. FIG. 7 illustrates how the intended direction for swimmer C in FIG. 6 can be updated after he corrects his direction.

FIG. 7 shows that after 50 feet swimmer C determines that he is swimming in the wrong direction (e.g. by sighting) and turns to the left. Swimmer C continues to swim to the left for approximately another 30 feet. Base unit 101 can continuously update the intended direction as swimmer C travels further from the starting point. For example, FIG. 7 shows that at 80 feet a new intended direction has been calculated that is based on the starting point and the swimmer's current location. The intended direction at 80 feet is slightly to the left of vertical. Similarly, base unit 101 calculates the intended direction at 100 feet and 120 feet.

As can be seen, even though swimmer C initially deviated off course, because base unit 101 continues to calculate an intended direction, the intended direction calculated later during the swim more closely approximates the correct vertical direction. Further, because the intended direction is calculated using the starting point (whether the initial starting point or the starting point of a subsequent leg) and the current position of the swimmer, the farther the swimmer swims, the more accurate the intended direction becomes.

Figure 8:
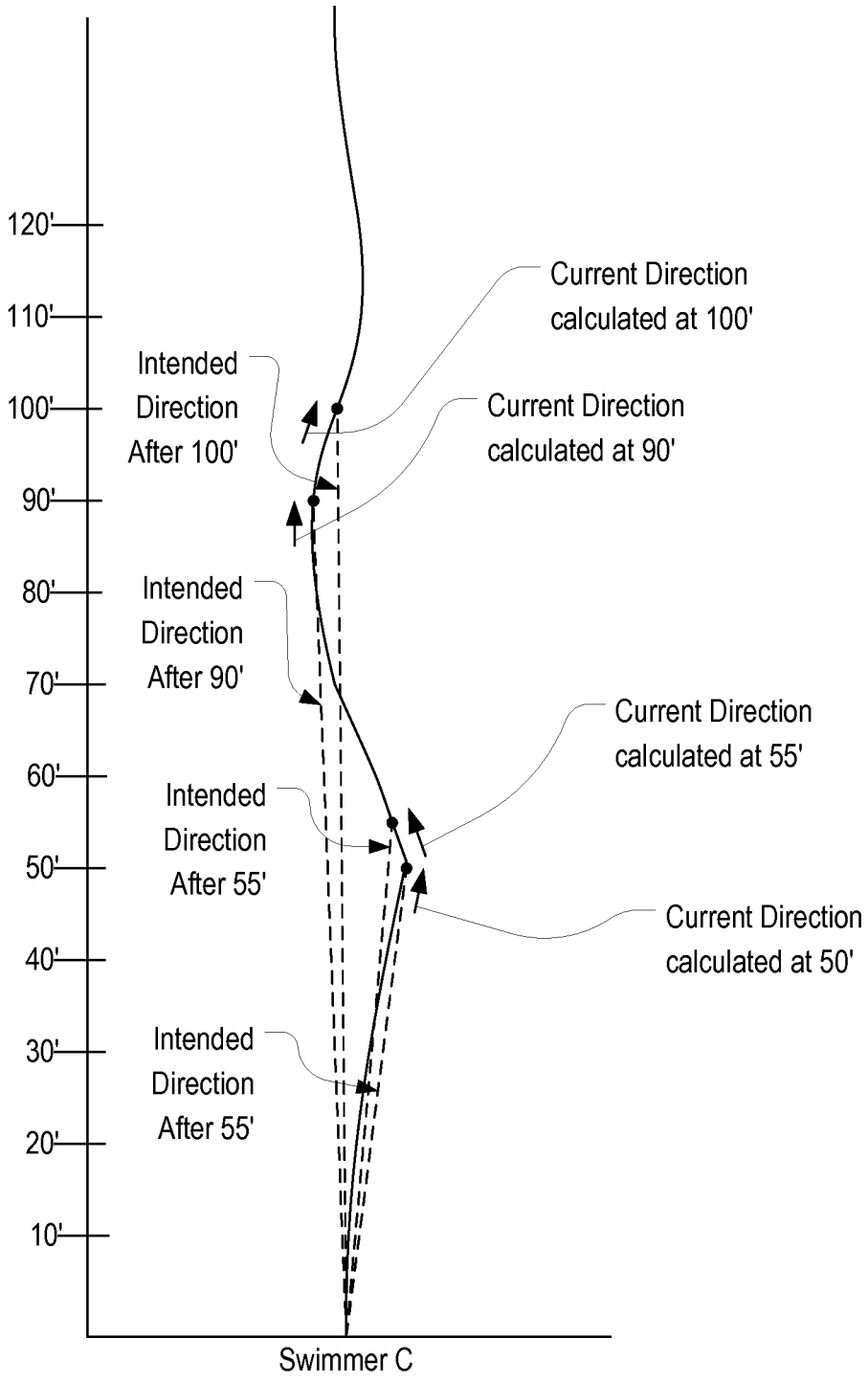
FIG. 8 illustrates how current direction can be calculated.

FIG. 8 shows the graph of FIG. 7 with the addition of the current direction calculated at three points during the swim: 50 feet, 55 feet, and 90 feet. The current direction can be calculated using the GPS coordinates received over a relatively short distance. For example, the GPS data corresponding to the previous five to ten feet traveled can be used. Of course, any suitable distance can be used to calculate the current direction.

At 50 feet, the current direction is shown as being determined using the swimmer's position at 45 feet and 50 feet. Because the swimmer has swum in a substantially straight line between the starting point and 50 feet, the intended and current direction are the same. Accordingly, at 50 feet, base unit 101 can notify the swimmer that he is swimming in the correct direction.

However, at 50 feet, the swimmer determines that he is swimming in the wrong direction and turns to the left. Therefore, at 55 feet, the current direction is shown as being angled to the left of the intended direction. In this case, base unit 101 can notify the swimmer that he is swimming to the left of the intended direction. Because the swimmer knows that his initial direction was wrong, he can ignore these notifications.

By 90 feet, the swimmer has returned back on course and has now begun to swim in a generally vertical direction. Accordingly, the intended and current directions at 90 feet are generally the same. Therefore, base unit 101 can notify the swimmer that he is heading in the right direction.

Finally, at 100 feet, the swimmer has begun to deviate to the right. Accordingly, base unit 101 can notify the swimmer of the right deviation. As shown, the swimmer follows the notification and returns back to swim in a generally vertical direction. In this way, base unit 101 can continually monitor the current direction of the swimmer and compare it to the intended direction to identify when the swimmer has deviated.

Example Display of Directional Indications

Figure 9:
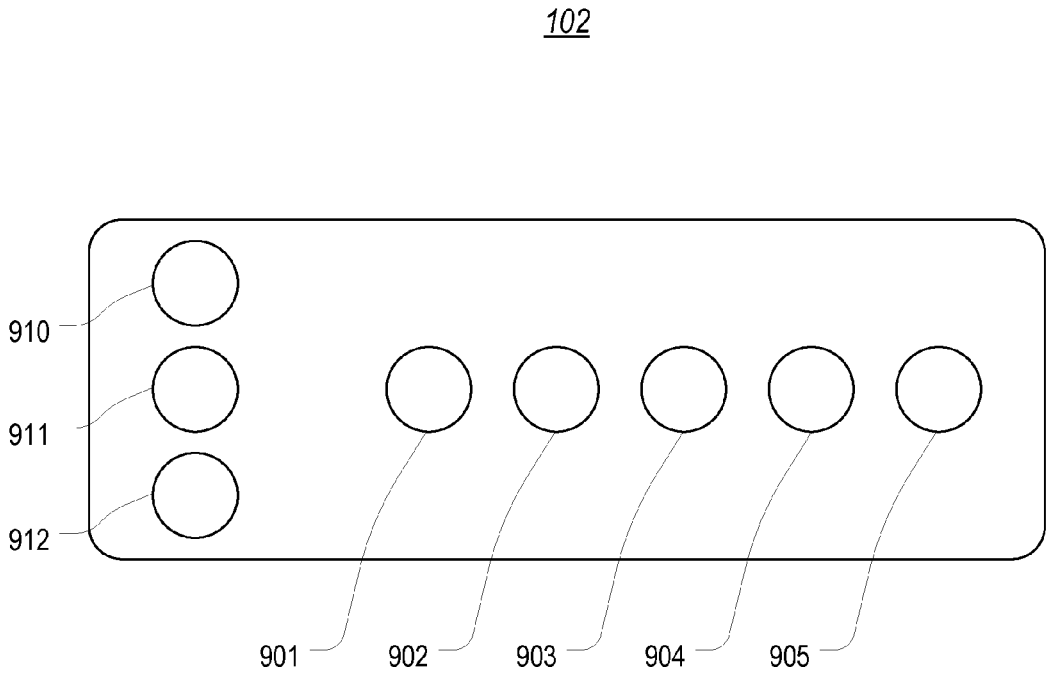
FIG. 9 illustrates an example configuration of an eyepiece of the GPS device.

FIG. 9 illustrates a non-limiting example of eyepiece 102 according to one or more embodiments of the invention. Eyepiece 102 can include five directional LEDs 901-905 and three other LEDs 910-912 that can be used to provide feedback regarding other parameters such as pace, cadence, heart rate, etc.

In this embodiment, LED 903 serves as a reference. When the swimmer's current direction matches or is within a threshold of the intended direction (in any of the modes), only LED 903 can be lit. LEDs 901 and 902 serve as indications that the current direction is to the left of the intended direction. LED 902 can be lit when the difference between the current direction and the intended direction exceeds a first threshold while LED 903 can be lit when the difference exceeds a second larger threshold.

LEDs 904 and 905 can function in a similar manner as LEDs 901 and 902 but can be lit when the swimmer's current direction is to the right of the intended direction. In some embodiments, to let the swimmer know that an intentional turn has been detected (e.g. when starting a new leg) each of LEDs 901-905 can be flashed.

In some embodiments, LED 903 can remain constantly lit during use of GPS device 100. For example, when the swimmer deviates to the left in excess of the first threshold, LEDs 902 and 903 can be lit at the same time. Similarly, when the swimmer deviates to the left in excess of the second threshold, LEDs 901, 902, and 903 can be lit at the same time. By maintaining the inner LEDs lit when the outer LEDs are lit, it can be easier for the swimmer to identify when his direction has deviated.

In some embodiments, LEDs 910 and 911 can be used to provide feedback regarding the swimmer's pace. For example, prior to a swim, the swimmer can input a desired pace to maintain. Then, during the swim, base unit 101 can monitor the swimmer's current and/or overall pace. If the pace is slower than the desired pace, one or both of LEDs 910 and 911 can be lit (e.g. a green LED indicating to go faster). If the pace matches the desired pace, both of LEDs 910, 911 can be off. On the other hand, if the pace is faster than the desired pace, the other LED can be lit (e.g. a red LED). Various blinking patterns may be used to indicate the severity of the difference between the actual and target pace.

In some embodiments, LED 912 can be used to provide cadence feedback. For example, prior to a swim, the swimmer can input a desired cadence. Then, during the swim, LED 912 can blink at a frequency matching the desired cadence. In this way, the swimmer can attempt to match his cadence to the frequency at which LED 912 is flashing. In alternate embodiments, base unit 101 can be configured to detect the swimmer's actual cadence (e.g. using an accelerometer or other motion sensing device), and can provide visual indications when the actual cadence matches a desired cadence (e.g. similar to how LEDs 910 and 911 are used to provide pace feedback).

Other configurations of LEDs can also be used to provide visual indications to the swimmer. For example, a single LED can be used to provide visual indications for deviations in a direction. In such cases, the brightness of the LED can be varied to indicate the degree of the deviation. Similarly, LED configurations can be used to form arrows to provide the indication of the direction to swim or the direction of the deviation.

Figure 10:
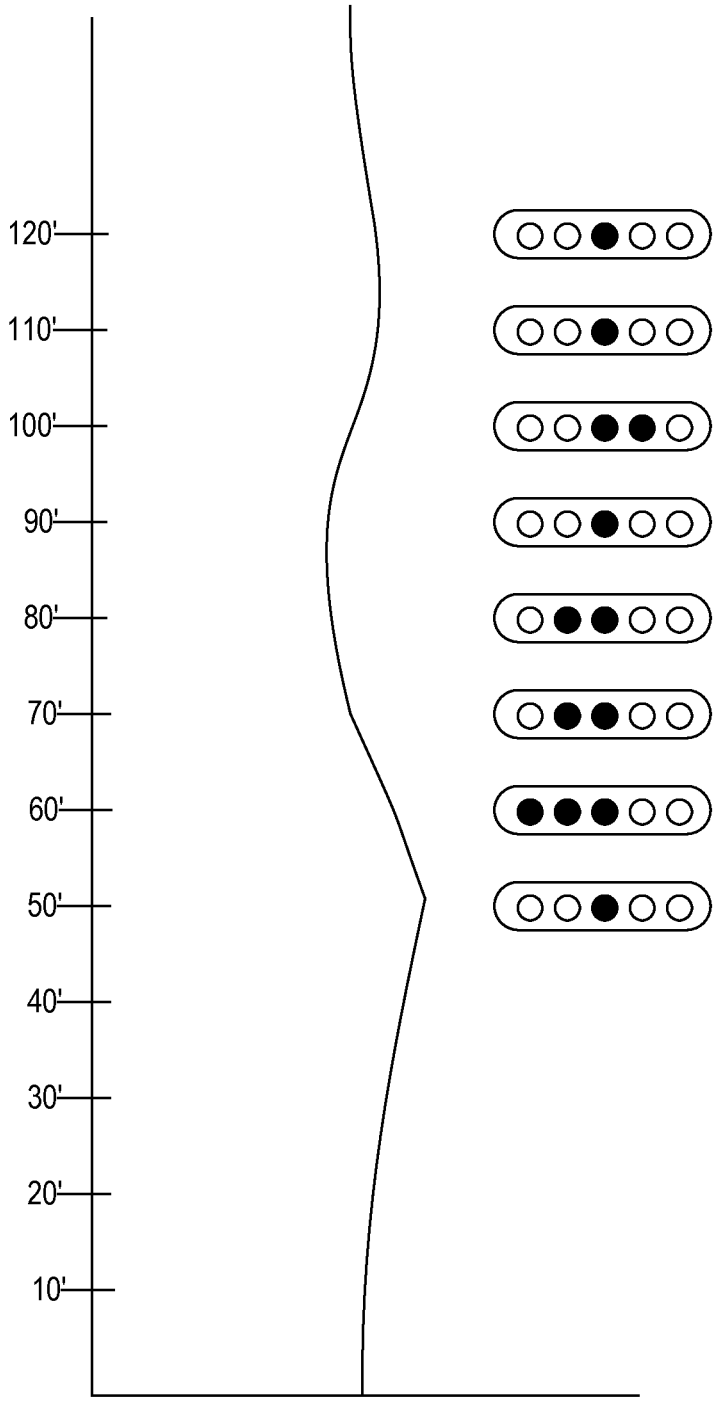
FIGS. 10 and 11 each illustrate an example of how the LEDs of an eyepiece can be lit to indicate the occurrence of a deviation from the intended direction.

FIG. 10 illustrates an example of how LEDs 901-905 can be lit while the swimmer traverses the path of FIG. 7 when using GPS device 100 in freestyle mode. At 50 feet, because the swimmer's current direction is the same as the intended direction initially calculated, only LED 903 is lit thereby indicating that the swimmer is heading in the correct direction. By 60 feet, the swimmer has turned back to the left which is a substantial deviation from the intended direction. Therefore, both LEDs 901 and 902 in addition to LED 903 are lit at 60 feet. By 70 feet, the difference between the current direction and the intended direction falls below the second threshold (due to the correction in the intended direction) and therefore LEDs 902 and 903 are lit.

At 80 feet, the current direction remains to the left of the intended direction. Accordingly, LEDs 902 and 903 remain lit. By 90 feet, the current direction and the intended direction are generally the same resulting in only LED 903 being lit. At 100 feet, the swimmer's current direction is to the right of the intended direction, and therefore, LEDs 903 and 904 are lit. Finally, at 110 and 120 feet, the current direction matches the intended direction. As such, LED 903 is the only one lit.

In this example, because the swimmer initially swims substantially off course, the directional indications do not become helpful until around 90 feet. However, after 90 feet, if the swimmer follows the directional guidance provided by the LEDs, he will quickly return on course when he deviates. For example, at 100 feet, the swimmer is notified that his current direction is to the right of the intended direction, and in response, he quickly turns back until only LED 903 is lit. As the swimmer continues past 120 feet, as long as he corrects his direction when he is notified of a deviation, he will remain on course without needing to sight.

It is noted that the example given in FIG. 10 illustrates an atypical scenario where the swimmer deviates quickly off course. In a typical scenario, the swimmer will start out in the correct direction, and therefore the intended direction initially calculated will be much closer to the actual correct direction resulting in the visual indications being helpful from the beginning.

As mentioned above, in some embodiments, LEDs 901-903 can be used to provide indications of the direction to swim rather than the direction of a deviation. In such cases, the LED pattern can be a mirror image of what is shown in FIG. 10.

Figure 11:
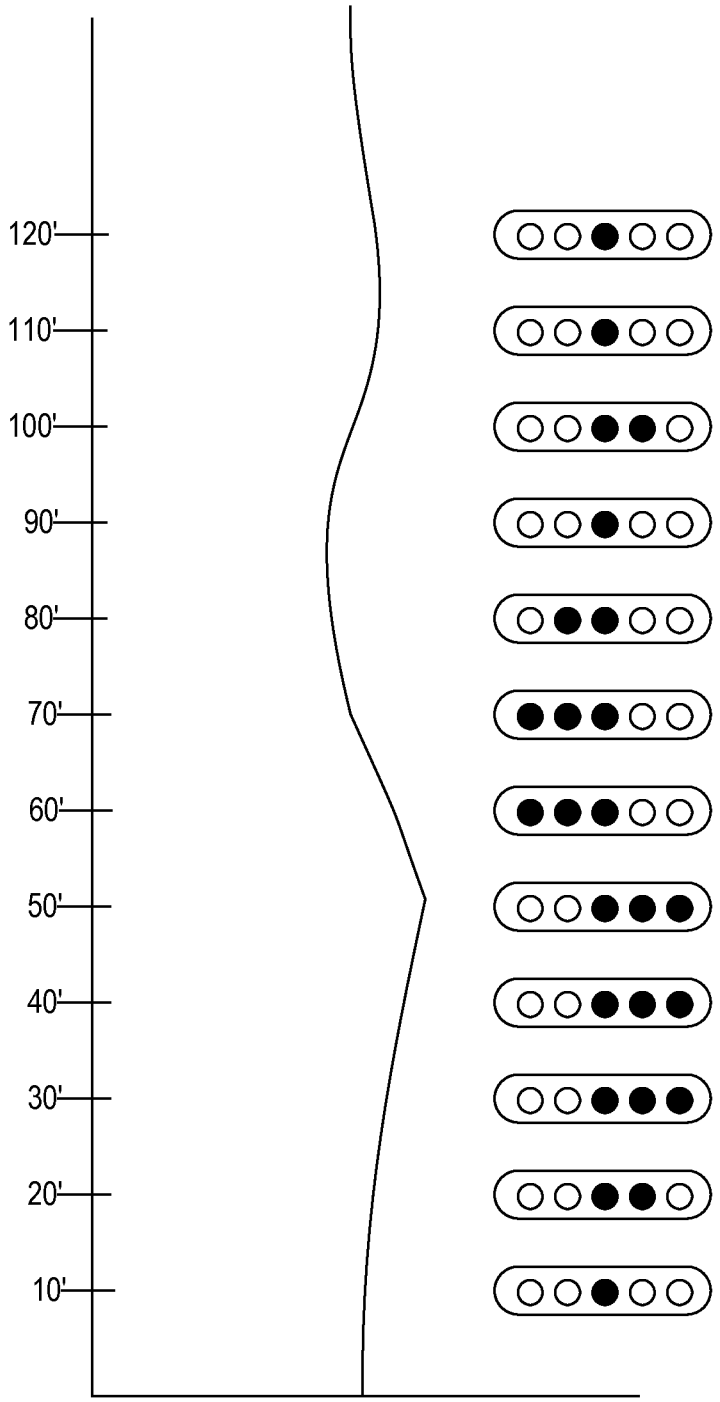

FIG. 11 illustrates another example of how LEDs 901-905 can be lit while the swimmer traverses the path of FIG. 7 when using GPS device 100 in the pre-programmed course or pre-programmed direction modes. Because the intended direction remains constant (directly vertical in this example) in these modes, if the current direction deviates from vertical, the swimmer can be notified accordingly.

In some embodiments, GPS device 100 can be used to compensate for a natural curve in a swimmer's stroke. For example, if a swimmer naturally curves to the right while swimming, base unit 101 can be configured to provide visual indications prompting the swimmer to swim to the left. These indications can train the swimmer to compensate for the rightward curve and can eventually result in the swimmer naturally swimming straight.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Other Embodiments and Features

While in some embodiments GPS device 100 may uses GPS to determine direction, other implementations are also possible. Usage of other direction sensing electronic hardware or components may be used, for example and without limitation compass chips, magnometers, and/or accelerometers. Accordingly, the specific logic that is utilized to determine intended and current directions for device 100 may differ, however the end result is essentially the same. Thus, regardless of the specific logic incorporated into device 100, the swimmer is able to receive real-time directions and guidance from device 100, in accordance with the teachings of the instant invention.

While GPS device 100 uses eyepiece 102 on the swimmers goggle to notify them of pertinent information, other embodiments are possible. Usage of other feedback devices may be used (e.g. auditory feedback, haptic feedback). With the example of auditory feedback, the swimmer would hear when he is off course instead of visually seeing that he was off course. In the case of haptic feedback he would feel when he is off course. This could be done by placing haptic feedback components on various locations of the body (e.g. shoulders, side, chest).

EXAMPLES

Example 1

Non-GPS Direction Sensing

In some instances, the present invention provides a non-GPS direction sensing device. In particular, some embodiments provide a device similar in structure and function to GPS device 100, yet which uses direction sensing hardware that does not rely on GPS to determine the intended direction. Thus, the calculations of the non-GPS direction sensing device differ significantly from those used by GPS device 100. For example, instead of calculating the intended direction from two or more GPS coordinates, the non-GPS device takes directional readings from one or more non-GPS direction sensing hardware components (e.g. compass chips, magnometers, accelerometers). In some instances, the non-GPS device utilizes non-GPS direction sensing hardware components to calculate the direction of the device. In some instances, the non-GPS device utilizes non-GPS direction sensing hardware components to calculate the direction of the device and further uses GPS direction sensing hardware components to track an intended direction and a current direction.

In some embodiments an intended direction is determined or tracked by using various methods, such as taking a single reading at the beginning of a swim path, averaging multiple readings taken during completion of a swim path, and/or pre-saving known directions which may be used by the device during completion of a swim path. The current direction of the swimmer is determined or tracked by using various methods, such as taking one or more single readings at various intervals during completion of the swim path, and/or averaging two or more collected readings, or combined readings. By comparing the collected data of the intended direction and the current direction, it is possible to provide or display directional information to the swimmer in order to keep the swimmer on an intended swim path.

The various embodiments of the present invention may include any direction sensing component that is compatible with the intended use and function of the instant device. In some embodiments, multiple sensors, or direction sensing components may be used. For example, in one embodiment a single direction sensing device of the instant invention combine two or more direction sensing components selected from the group consisting of a GPS sensor, a magnometer, an accelerometer, and a compass chip, in any configuration. Accordingly, the present invention may comprise a single device that is capable of providing multiple values from which the direction of the device may be calculated. In some instances, two or more values derived from two or more direction sensing components are used to derive a direction and/or location of the device. For example, in some instances a device of the instant invention combines an accelerometer and compass chips to determine direction compared to the pull of gravity and/or earth's magnetic field. In some instances, a device of the instant invention utilizes two or more direction sensing components or sensors to infer additional information for the device, such as speed and/or distance of the device. In some embodiments, the device of the instant invention comprises one direction sensing device (for example a GPS sensor) as a default, and further comprises a second direction sensing device (for example a magnometer component) for use if the default sensor fails or is otherwise unavailable. For example, the device may be configured to use GPS, unless a positive satellite fix is unavailable. In this instance, the device may be configured to automatically switch to the second direction sensing device, wherein the device determines its direction via the magnometer. Where a positive satellite fix is available, the device may be configured to averaging data between the GPS sensor and the magnometer component to provide better accuracy. Thus, the various embodiments of the instant invention may utilize any hardware configuration that is capable of determining and communicating accurate directional information to a user.

Example 2

User Interface

GPS device 100 (and other similar variations thereof) may use any compatible feedback hardware that is capable of communicating information to a user (i.e. swimmer) of the device. Thus, implementations of the present invention are not limited to visual user interfaces which require the use of one or more LEDs. Non-limiting examples of compatible feedback hardware include haptic feedback components, and audio signals. In some instances, a GPS device 100 is provided which utilizes auditory signals to provide directional feedback to the user. In some instances, the auditory signals comprise real-time or pre-recorded messages. In some instances, the auditory signals comprise a beeping noise, such as a single beep, a pattern of monotone beeps, or a pattern of beeps utilizing two or more tones.

GPS device 100 may further include one or more haptic feedback components. For example, a haptic feedback component may include one or more pieces of hardware that vibrate, pulse, create pressure, or lack of pressure. Through touch, the haptic feedback component may communicate to the user at least one of a direction, a speed, a distance, a pace, or other desired data. In some examples, the GPS device 100 utilizes two haptic feedback components that vibrate, each component being configured to attach to different locations of the user, such as each of the user's shoulders. Directional feedback may thus be communicated to the user by causing one of the haptic feedback components to vibrate to indicate a direction in which the user should swim. The haptic feedback components may further utilize a variety of vibration patterns, vibration lengths, and/or vibration intensities to communicate desired information.

The invention claimed is:

1. A device for providing directional guidance while swimming, the device comprising:

a base unit for generating directional information; and an eyepiece connected to the base unit, the eyepiece being configured to mount to goggles worn by a swimmer while swimming;

wherein the base unit is configured to:

as the swimmer traverses a path commencing at a start point, repeatedly calculate an intended direction based on the start point and a current location of the swimmer;

repeatedly identify a current direction of the swimmer using the current location and one or more previous locations;

compare the current direction to the intended direction calculated for the corresponding current location; and transmit commands for causing the eyepiece to display visual indications representing when the current direction deviates from the intended direction calculated for the corresponding current location.

2. The device of claim 1, wherein the eyepiece comprises a plurality of directional LEDs.

3. The device of claim 1, wherein the base unit is configured to be worn on the head.

4. The device of claim 3, wherein the base unit is configured to connect to at least one of a strap of the swimmer's googles or be placed underneath a swimmer's swim cap to thereby position the base unit on the back of the swimmer's head.

5. The device of claim 1, wherein the base unit is configured to be worn on the back of the head, the base unit being coupled to the eyepiece via a wired connection.

6. The device of claim 1, wherein repeatedly calculating the intended direction comprises updating the intended direction each time the base unit generates information defining a current location.

7. The device of claim 1, wherein the base unit is further configured to:

automatically determine that the current direction deviates from the intended direction calculated for the corresponding current location in excess of one or more thresholds; and in response, repeatedly calculate the intended direction based on a new start point and a current location of the swimmer, the new start point corresponding to a location where the base unit automatically determined that the current direction deviated from the intended direction in excess of the one or more thresholds.

8. The device of claim 1, wherein the base unit is further configured to:

optionally receive manual input from the swimmer indicating that the start point used to repeatedly calculate the intended direction should be reset; and in response, repeatedly calculate the intended direction based on a new start point and a current location of the swimmer, the new start point corresponding to a location of the swimmer when the input is received.

9. The device of claim 1, wherein the base unit is further configured to:

monitor a current pace of the swimmer;

compare the current pace to a desired pace; and transmit commands for causing the eyepiece to display visual indications representing whether the current pace is greater than, equal to, or less than the desired pace.

10. The device of claim 1, wherein the base unit is further configured to:

receive input identifying a desired cadence; and while the swimmer is swimming, transmit commands for causing the eyepiece to display visual indications representing the desired cadence by causing one or more lights to flash at a rate corresponding to the desired cadence.

11. The device of claim 1, wherein the eyepiece attaches to a lens of the swimmer's goggles.

12. The device of claim 1, wherein the base unit is further configured to optionally receive the intended direction from a target destination provided previously or by a paired device of another swimmer or assist vehicle.

13. A method for displaying directional information on goggles worn by a swimmer, the method comprising:

as the swimmer traverses a path commencing at a start point, repeatedly calculating an intended direction based on the start point and a current location of the swimmer;

repeatedly identifying a current direction of the swimmer using the current location and one or more previous locations;

comparing the current direction to the intended direction calculated for the corresponding current location; and displaying visual indications representing when the current direction deviates from the intended direction calculated for the corresponding current location.

14. The method of claim 13, wherein the visual indications are displayed by lighting one or more LEDs mounted to the goggles.

15. The method of claim 13, further comprising:

determining that the current direction deviates from the intended direction calculated for the corresponding current location in excess of a threshold; and in response, repeatedly calculating the intended direction based on a new start point and a current location of the swimmer, the new start point corresponding to a location where it is determined that the current direction deviated from the intended direction in excess of the threshold.

16. A device for providing directional guidance while swimming, the device comprising:

a base unit having a direction sensing component for generating directional information, the base unit being configured to be worn on the back of the head while swimming: and an eyepiece connected to the base unit via a wired connection, the eyepiece being configured to mount to goggles worn by a swimmer while swimming;

wherein the base unit is configured to:

repeatedly calculate, as the swimmer traverses a path commencing at a start point, an intended direction based on the start point and a current location of the swimmer, repeatedly identify current direction of the swimmer based on the current location and one or more previous locations;

compare the current direction to an intended direction calculated for the corresponding current location; and transmit information commands for causing the eyepiece to display visual indications to the swimmer to communicate directional information when the current direction deviates from the calculated intended direction.

17. The device of claim 16, wherein the base unit is further configured to:

determine that the current direction deviates from the intended direction calculated for the corresponding current location in excess of a threshold; and in response, repeatedly calculate the intended direction based on a new start point and a current location of the swimmer, the new start point corresponding to a location where the base unit determined that the current direction deviated from the intended direction in excess of the threshold.

18. The device of claim 16, wherein the base unit is further configured to:

receive input identifying a desired cadence; and while the swimmer is swimming, transmit commands for causing the eyepiece to display visual indications representing the desired cadence.

19. The device of claim 16, wherein the base unit is further configured to:

monitor a current pace of the swimmer;

compare the current pace to a desired pace; and transmit commands for causing the eyepiece to display visual indications representing whether the current pace is greater than, equal to, or less than the desired pace.

* * * * *